US006802253B2

(12) United States Patent
Langsch

(10) Patent No.: US 6,802,253 B2
(45) Date of Patent: Oct. 12, 2004

(54) ROTATIONAL BODY CONFIGURATION FOR WEB WIDTH CORRECTION

(75) Inventor: Robert Langsch, Ortschwaben (CH)

(73) Assignee: Maschinenfabrik Wifag, Bern (CH)

( * ) Notice: Subject to any disclaimer, the term of this patent is extended or adjusted under 35 U.S.C. 154(b) by 0 days.

(21) Appl. No.: 10/372,355

(22) Filed: Feb. 24, 2003

(65) Prior Publication Data

US 2003/0172822 A1 Sep. 18, 2003

Related U.S. Application Data

(62) Division of application No. 09/670,491, filed on Sep. 26, 2000, now Pat. No. 6,550,384.

(30) Foreign Application Priority Data

Nov. 16, 1999 (DE) ..... 199 55 099

(51) Int. Cl.[7] ..... B41F 5/16

(52) U.S. Cl. ..... 101/180; 101/178; 101/219; 101/225

(58) Field of Search ..... 101/178, 180, 101/181, 216, 219, 225, 220, 420, 417, 418, 454; 226/1, 88, 93, 80; 492/28, 31, 30, 37, 38, 39

(56) References Cited

U.S. PATENT DOCUMENTS 553,542 A 1/1896 Richter
3,339,441 A * 9/1967 Haley ..... 226/80
4,087,226 A * 5/1978 Mercer ..... 425/397
4,696,230 A * 9/1987 Barkley ..... 101/181
4,792,076 A 12/1988 Grunder
5,050,500 A * 9/1991 Spiess ..... 101/420
5,611,275 A * 3/1997 Iijima et al. ..... 101/181
5,720,813 A * 2/1998 McDonald ..... 118/314
5,729,878 A * 3/1998 Kurihara et al. ..... 26/101
5,913,267 A 6/1999 Britsch
5,980,444 A * 11/1999 Dickhoff ..... 493/433
6,189,449 B1 * 2/2001 Tomita et al. ..... 101/180
6,550,384 B1 * 4/2003 Langsch ..... 101/225

FOREIGN PATENT DOCUMENTS

| | | |
|---|---|---|
| DE | 33 10 450 | 8/1984 |
| DE | 87 03 732.7 | 6/1987 |
| DE | 43 27 646 | 4/1994 |
| DE | 195 16 368 | 11/1996 |
| EP | 0 253 981 | 1/1988 |
| EP | 0 838 420 | 4/1998 |
| WO | WO 99/40006 | 8/1999 |

* cited by examiner

*Primary Examiner*—Eugene H. Eickholt
(74) *Attorney, Agent, or Firm*—McGlew and Tuttle, P.C.

(57) ABSTRACT

A rotary printing machine, in particular in a reel-fed newspaper offset rotary press is provided with a device for correcting the web width. A rotatively mounted rotational body configuration is arranged in the path of the web between two print printing nips (2, 3) on one side of the web. The rotational body configuration (5; 6) has a wave-like profile that is transverse to the running direction of the web.

9 Claims, 12 Drawing Sheets

ROTATIONAL BODY CONFIGURATION FOR WEB WIDTH CORRECTION

Figure 1:
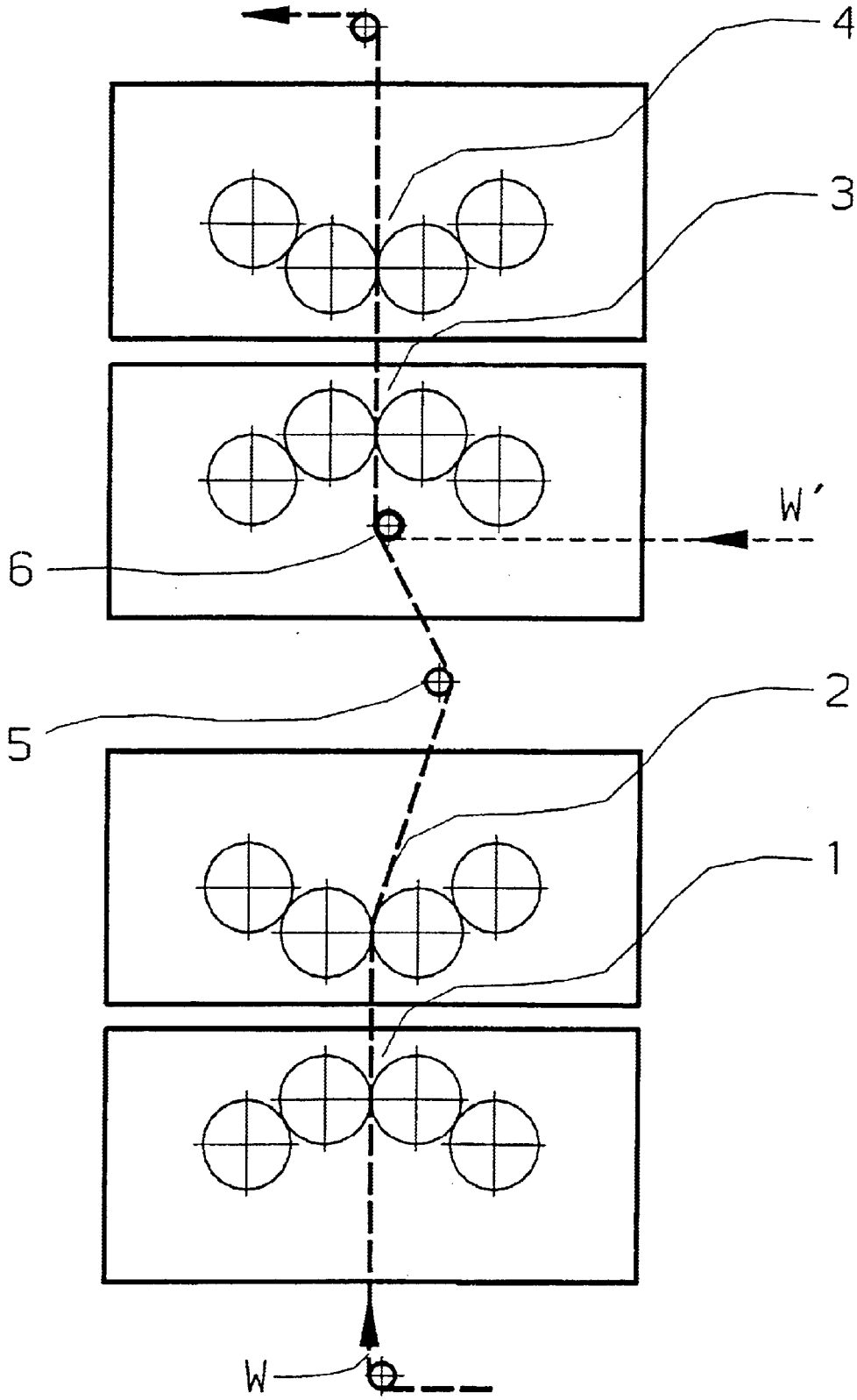

This application is a divisional of U.S. Ser. No. 09/670,491 filed on Sep. 26, 2000 and now U.S. Pat. No. 6,550,384.

FIELD OF THE INVENTION

The invention relates to a rotational body configuration and a method for a web width correction between two printing positions of a rotary printing machine. The printing machine concerned is preferably a wet-on-wet printing machine, in particular an offset printing machine, particularly preferred being a reel-fed rotary printing machine.

BACKGROUND OF THE INVENTION

In wet-on-wet print rotary printing machines, transverse strain changes occur due to the moistness of the web. This phenomenon, known as fan-out effect, has the undesirable effect that the width of the web, measured transversely to its running direction, varies between two printing nips where the web is printed in sequence. The web, moistened in the one printing nip, swells in its path and becomes wider by the time it reaches the next printing nip. If measures to correct this are not taken, misprints arise in the transverse direction of the web in the printing cylinders forming the printing nips.

One possibility of correcting this, as disclosed, for example, in DE 195 16 368 C2, is to axially adjust the position of the print plates of the plate cylinders which transfer the respective print images on the printing cylinders of the printing nips.

As an alternative to shifting the position of the print plates, it is known to correct the web width. Thus, a device for correcting the fan-out effect on reel-fed rotary printing machines is known from the generic patent specification EP 0 838 420 A2, with which the web is deformed in a wave-like manner transversely to its running direction before entering the subsequent printing nip. The web is guided through two arrays of rolls in the device. The rolls of the one array are arranged staggered to the rolls of the other array transversely to the running direction. As at least one of the two roll arrays is movable into the path of the web, a wave-like profile is imposed on the web, and thus the web width for the print in the subsequent printing nip is reduced.

Comparable devices are known from DE 43 27 646 A1. This document discloses correcting devices comprising rotational body configurations arranged on both sides of the web, and also devices having rotational body configurations arranged only on one side of the web, with which the web is deformed in a wave-like manner transversely to its running direction.

In this device, the web is guided linearly through a number of printing sections, between which a web width correction device is arranged, respectively. This device comprises a number of peripheral projections, laterally spaced away from each other, in the form of rings or brush bodies. Due to the linear web guidance, the web only comes into contact with the peripheral projections, between which the web is freely guided.

WO 99/40006 A1 discloses a guide roll for correcting the side location of webs or also of longitudinal folds. These guide rolls are employed subsequent to the web being printed, whereby the web may also partially wind around the guide roll. The guide roll comprises at least two outer ( i.e. near journal of a shaft) expanding elements, which vary in diameter and are located in the region of the ends, the elements being pressurized with pressure means in order to expand. However, guide rolls are not known to be employed for correcting the fan-out effect.

A further device with only local applying of pressure to the web is disclosed in U.S. Pat. No. 5,553,542. A number of distanced rolls or compressed air nozzles, the latter being located in the direct vicinity of the web, are provided for applying pressure to the web in order to correct the fan-out effect. Due to the web being guided linearly and vertically, the web partially winds around the pressure application locations only, while otherwise being guided linearly and vertically, however.

Further guide roll means are disclosed in the book of Walewski, Wolfgang: Der Rollenoffsetdruck, Fachschriften-Verlag, 1995, page 94, in German patent specifications DE 33 10 450 C1 and DE 87 03 732 U1, as well as in the European patent specification EP 0 253 981 B1.

In these known devices, the web is guided past the deforming rotational body configurations, decisive web contact only being necessary as a result of web width correction. For this purpose, the rotational body configurations are advanced into the path of the web. Correcting the web width in this way automatically results in the length of the web being changed between the printing nips. Upon printing in the subsequent printing nip, circumferential register errors arise, or circumferential register corrections are required matching the web width correction.

SUMMARY AND OBJECTS OF THE INVENTION

It is an objective of the invention to enable a web width correction which does not require matching circumferential register corrections.

The invention relates to a rotational body configuration for a web width correction between an upstream printing nip and a downstream printing nip of a rotary printing machine, which is preferably a reel-fed newspaper offset rotary printing press. In the two printing nips, in printing production, a web, passing through, is printed in sequence. The rotational body configuration is arranged on one of the two sides of the web and is rotatable in the running direction of the web. In axial direction, it comprises alternatingly juxtaposed radially protruding shell portions and radially retracting shell portions in order to deform the web in a wave-like manner transversely to its running direction.

In accordance with the invention, the rotational body configuration is arranged in a path of the web between the upstream printing nip and the downstream printing nip such that, or the web is guided on its way between the printing nips such that, the web, in the protruding shell portions and in the retracting shell portions, permanently winds around in part the rotational body configuration, i.e. the web permanently contacts not only the protruding shell portions, but also the retracting shell portions throughout the entire printing production. This thus assures neat linear guidance of the web at all times.

In accordance with the invention, for web width correction, a web is not guided past a rotational body configuration, provided for this purpose, which would need to be moved into the path of the web for the purpose of web width correction. In accordance with the invention, the web permanently winds around in part the rotational body configuration. The rotational body configuration in accordance with the invention permanently redirects the web. The web partially winds around the rotational body configuration by at least 3°, i.e. it is permanently redirected by at least 3° by the rotational body configuration. A higher wrap angle of approx. 5° or more is preferred. Advantageously, the rotational body configuration is wound around in part by 10° or more. The wrap angle may be as much as 180°.

Due to the invention, one such rotational body configuration may be formed by a single rotational body comprising the protruding shell portions and the retracting shell portions as a non-variable surface shape. The fixed arrangement of such a rotational body, rotatable as a whole, has surprisingly proved to already be sufficient to significantly reverse an expansion of the web such that further web width corrections to achieve a sufficiently good register transversely are not necessary. Adjustments for the width correction, for example, depending on the type of paper and/or web speed is achievable by slightly modifying the longitudinal tension of the web specifically. Preferably, such a rotational body is configured in a wave-like manner at its surface in longitudinal direction. It is particularly preferred that it has concave and convex, or protruding and retracting shell portions continuously merging into the other. The web is in contact with such a rotational body at all times over its full width. The amplitude of the wavy shell surface area, and preferably also the radial distance between the protruding and retracting shell portions of the other example embodiments, is preferably in the range of 0.2 to 3 mm, it preferably amounting to approx. 2 mm.

In preferred example embodiments, the protruding shell portions are radially movable relative to the retracting shell portions, as a result of which the width correction portion can be enlarged, for example by adapting to different paper qualities, web speeds or also by adapting to different printing conditions of the web and thus the different moistenings involved. Due to the relative movement occurring in accordance with the invention between the protruding shell portions and the retracting shell portions, varying web width corrections are already possible solely with one rotational body configuration in accordance with the invention arranged only on one side of the web.

A constant web length between the upstream printing nip and the downstream printing nip is maintained preferably by compensating for the relative movements between the protruding and the retracting shell portions.

In a preferred first embodiment, the protruding shell portions and the retracting shell portions, in a neutral position of the rotational body configuration, comprise a common neutral position axis of rotation. To vary the web width correction, i.e. to adjust the web width, the protruding shell portions are advanced to the web relative to the neutral position axis of rotation and the retracting shell portions are retracted from the web relative to the neutral position axis of rotation mirror-symmetrically in the opposite direction.

Due to this symmetrical adjustment, the mean path of the web between the upstream printing location and the downstream printing location remains the same, despite the adjustment, or is altered with respect to the circumferential register to a degree which is irrelevant practically, i.e. as regards print quality. To keep the length of the web path between the upstream print location and the downstream print location constant, it may also be of advantage to adjust the protruding shell portions and the retracting shell portions asymmetrically in opposite directions with respect to the neutral position axis of rotation. Preferably, given such an asymmetrical adjustment, the protruding shell portions are advanced to the web, relative to the neutral position axis of rotation, to a lesser extent than the retracting shell portions are retracted from the web relative to the neutral position axis of rotation. Preferably, the protruding shell portions, amongst themselves, and the retracting shell portions, amongst themselves, are likewise moved to the same degree during adjustment.

The symmetrical or asymmetrical adjustment may be effected, for example, by radially expanding the protruding shell portions and radially constricting the retracting shell portions. Preferably, the protruding shell portions are formed by an array of rotatively mounted first rolls, and the retracting shell portions are formed by an array of rotatively mounted second rolls.

In a further preferred embodiment, the rotational body configuration comprises a roll body, including eccentric sleeves, non-rotatively mounted thereon, on which cylinder sleeves are rotatively mounted, each independently of the other. Preferably, the eccentric sleeves are designed alternatingly differing in the axial direction of the roll body so that the cylinder sleeves can be advanced to and retracted from the web simply by rotational adjustment of the roll body in order to form protruding and retracting shell portions, preferably alternatingly.

In preferred further embodiments, the rotational body configuration is a roll comprising retracting shell portions, which are radially non-movable relative to the axis of rotation of the roll, and comprising protruding shell portions for advancing relative to the latter.

Advantageously, for compensating changes in the length of the web, which may be caused by movement of the protruding shell portions relative to the retracting shell portions, the rotational body configuration may be arranged radially movable as a whole. A variation of the web width correction may be compensated in this case by a matching radial dislocation of the entire rotational body configuration in the sense of maintaining the web length constant. This radial dislocation is achieved, for example, by mounting the rotational body configuration in eccentric bearings, as is known in principle in printing machine construction for other purposes. The radial movement of the rotational body configuration can also be achieved by means of a linear shifting, instead of a swiveling movement.

In order to adapt the correction of the web width to production requirements, in particular when the rotational body configuration is configured as a roll having a non-variable surface shape, in a further development, several rotational body configurations are rotatively mounted in a rotary cartridge. By rotating the cartridge around an axis of rotation thereof one of the rotational body configurations is brought selectively into a working position, while the other rotational body or bodies of the rotary cartridge remain/s in standby position(s) having no effect on the web. Only the rotational body configuration located in the working position is partially wound around by the web in accordance with the invention. The swivel arm length, formed by the rotary cartridge, may be the same for each of the rotational body configurations of the rotary cartridge. If each of the rotational body configurations is, for example, a rotational body configuration having a non-variable surface shape, and if the amplitude of the shell surface wave is symmetrically varied about its neutral line from one rotational body configuration to the other, then although the waviness imposing the web changes from one rotational body configuration to the next, and thus the set web width also changes, the mean path of the web nevertheless remains the same. Should this assumption not apply to the rotational body configuration of the rotary cartridge, the path of the web between the upstream printing nip and the downstream printing nip can still be maintained constant by selecting the length of the swivel arms, on which the rotational body configurations are mounted relative to their common swivel axis, in coordination with the individual rotational body configurations of the rotary cartridge in the sense of maintaining the web path constant.

Another advantage of the invention is that the rotational body configuration, serving to correct the web width in printing production, can be employed in another printing production as a pure deflection means for a web, which is printed either only in the upstream printing nip in the first printing production or only in the downstream printing nip in the first printing production. Preferably, the rotational body configuration is configured for the advantageous dual purpose so that the protruding and retracting shell portions, if movable relative to each other, can be set to a level relative to the web so that the rotational body configuration provides a smooth straight-cylindrical shell surface area for the web. If the protruding shell portions are cambered, i.e. permanently crowned, as may be the case in accordance with the invention, then the waviness resulting therefrom is so slight that no change in the web width occurs to an extent relevant in practice.

Preferably, in the path of the web between the upstream printing nip and the rotational body configuration or between the rotational body configuration and the downstream printing nip, a deflection means is arranged to guide the web partially winding around the rotational body configuration in accordance with the invention. In the preferred arrangement, the rotational body configuration is used as a guidance to linearly direct the web into the downstream printing nip. In this preferred application, it replaces a printing nip input roll needed in prior art.

BRIEF DESCRIPTION OF THE DRAWINGS OF THE DRAWINGS

Figure 2:
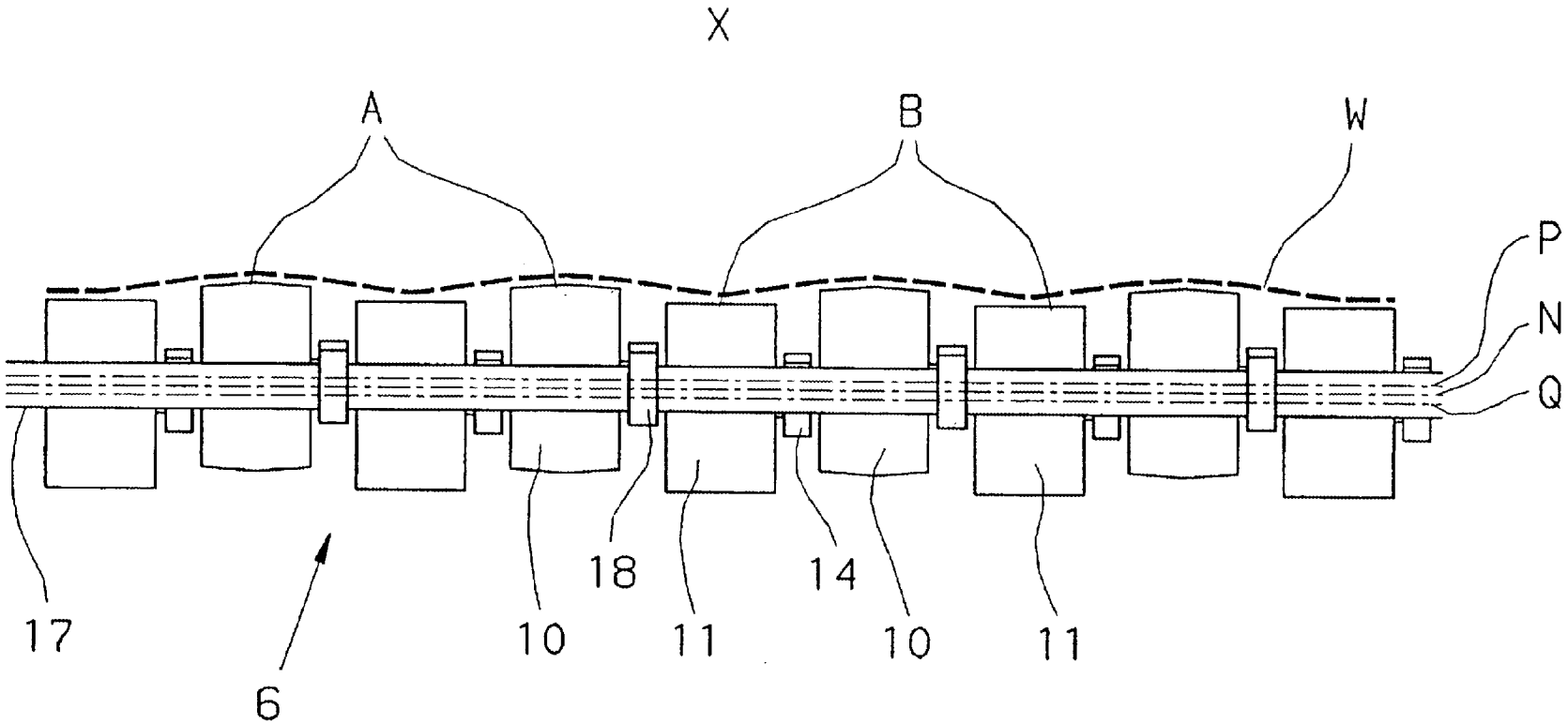
Figure 3:
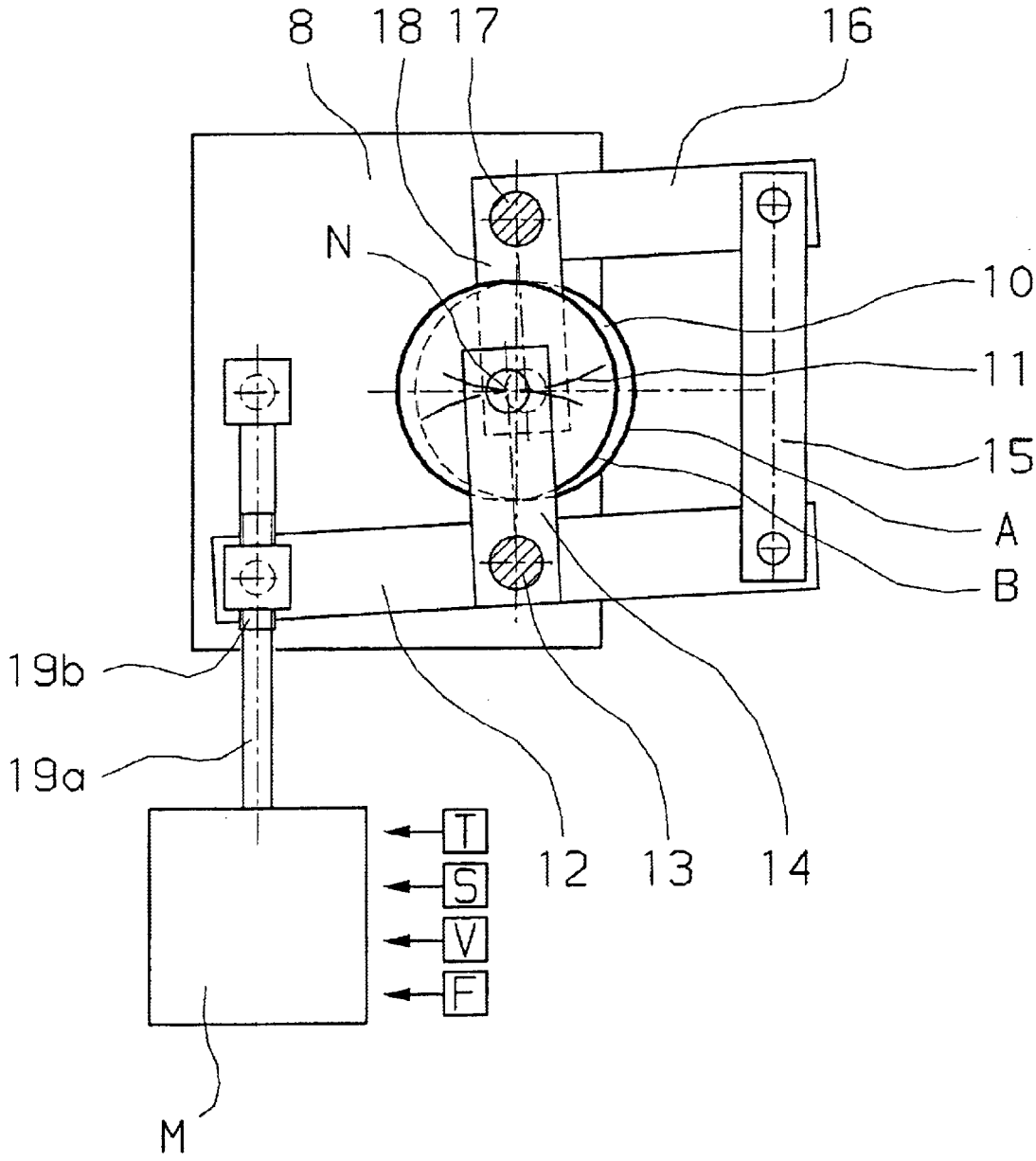
Figure 4:
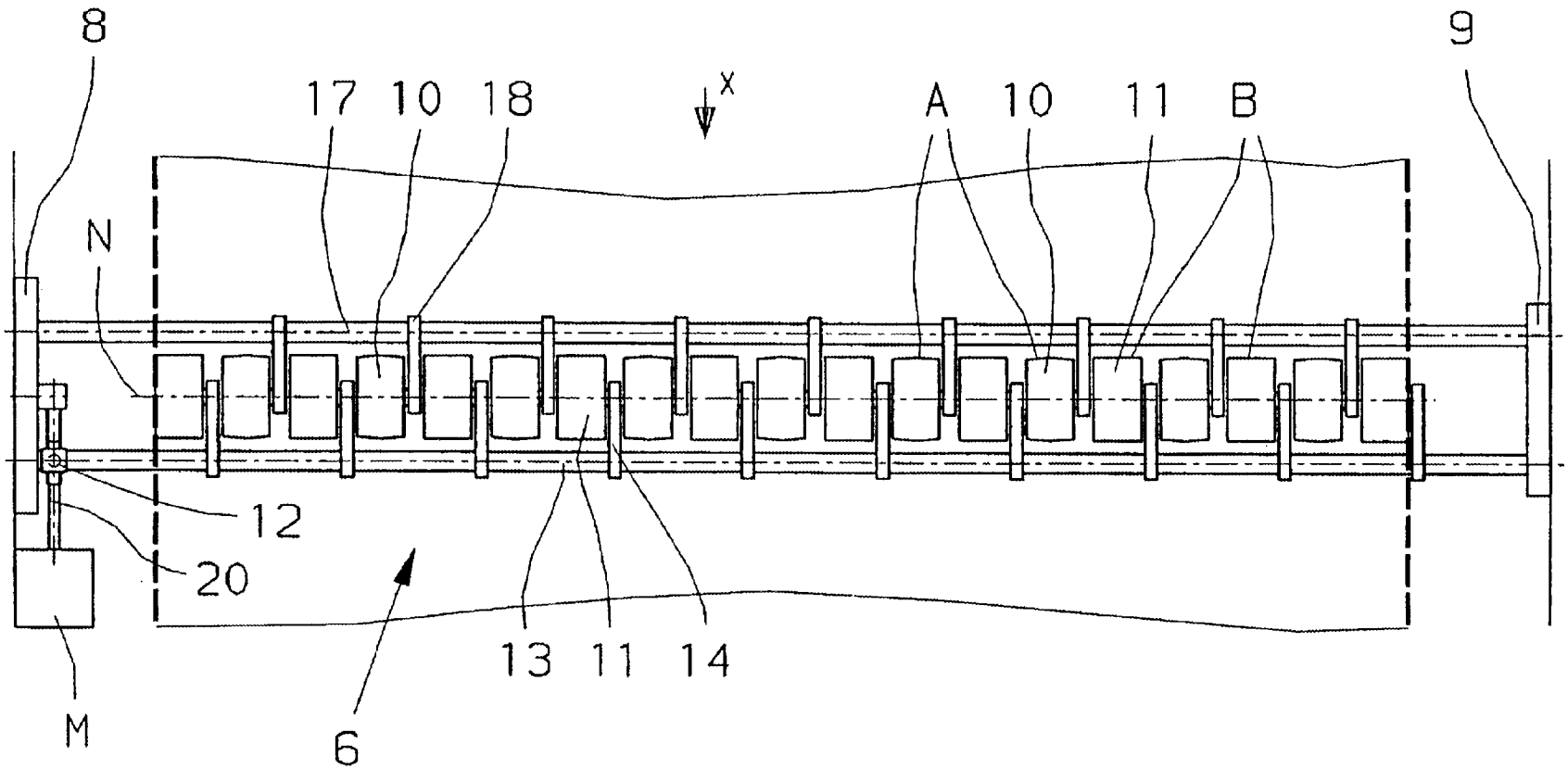
Figure 5:
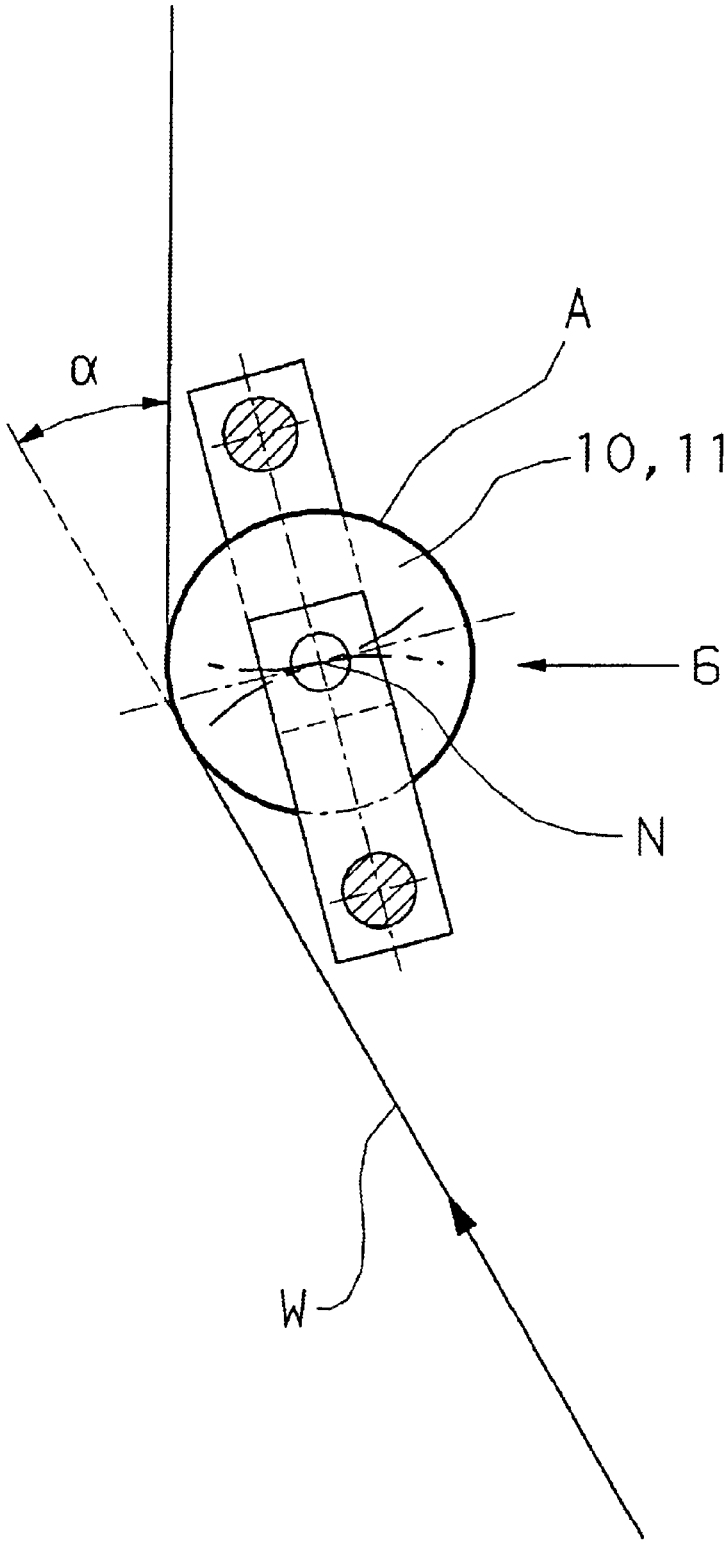
Figure 6:
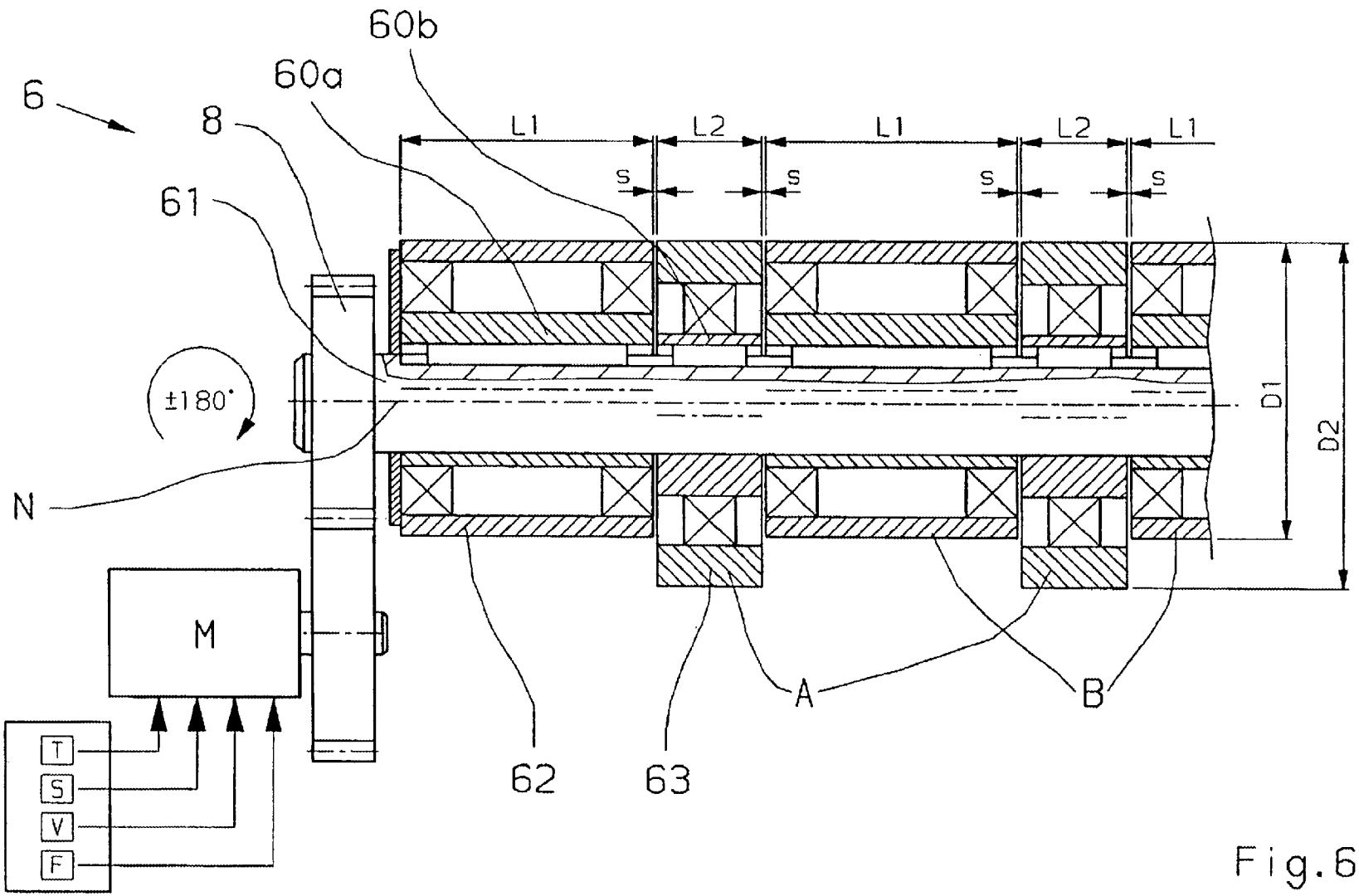
Figure 7:
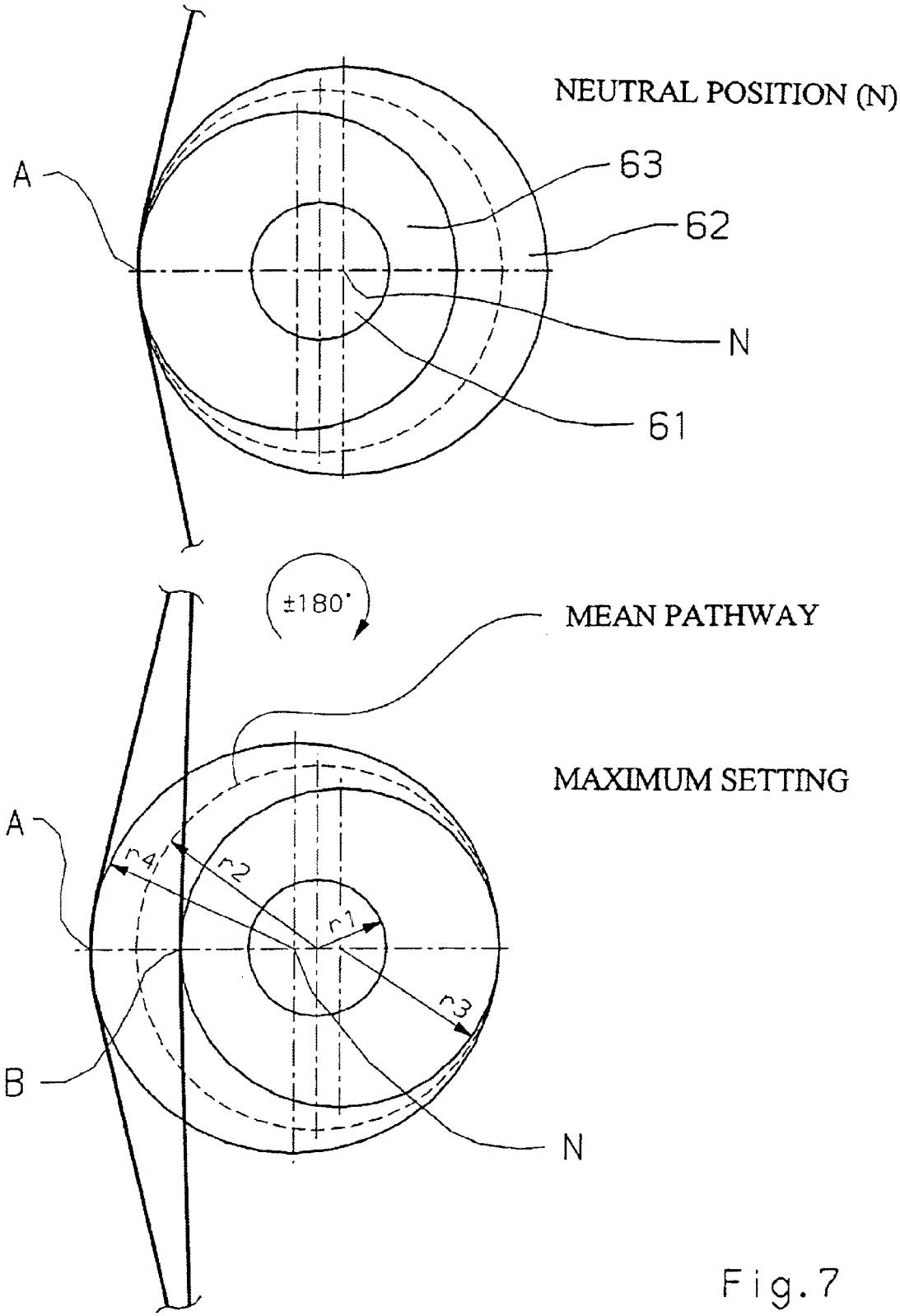
Figure 8:
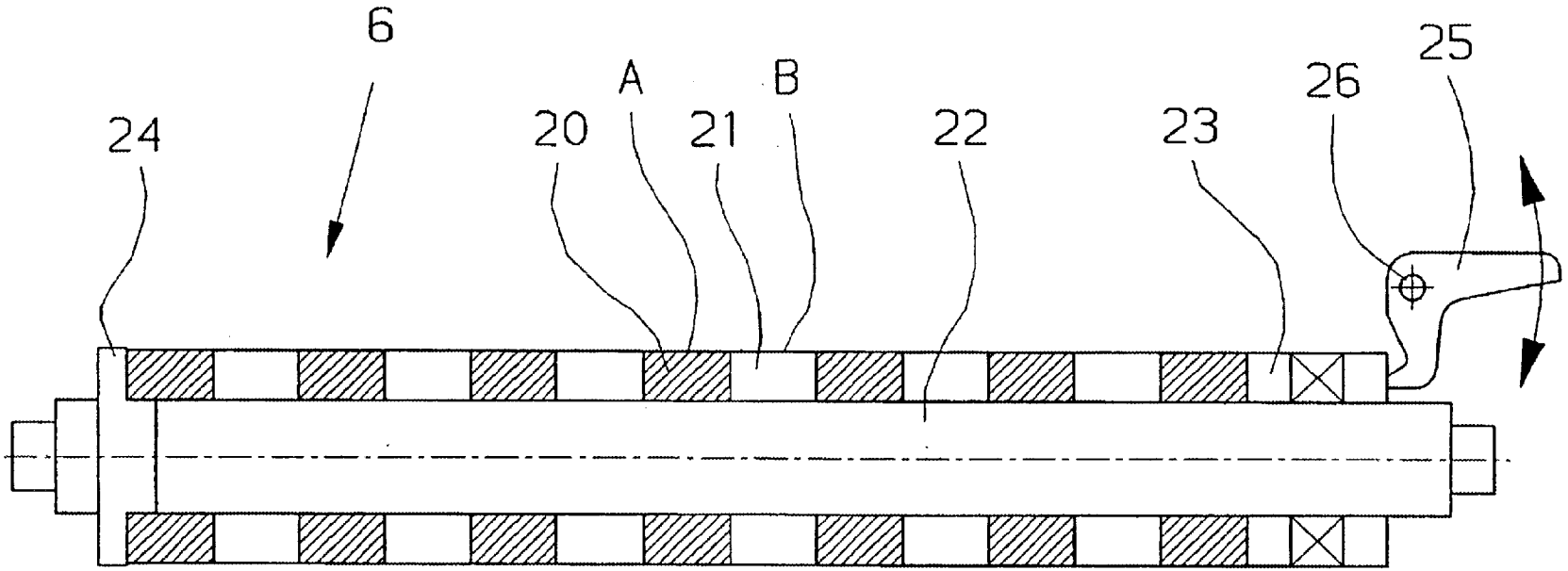
Figure 9:
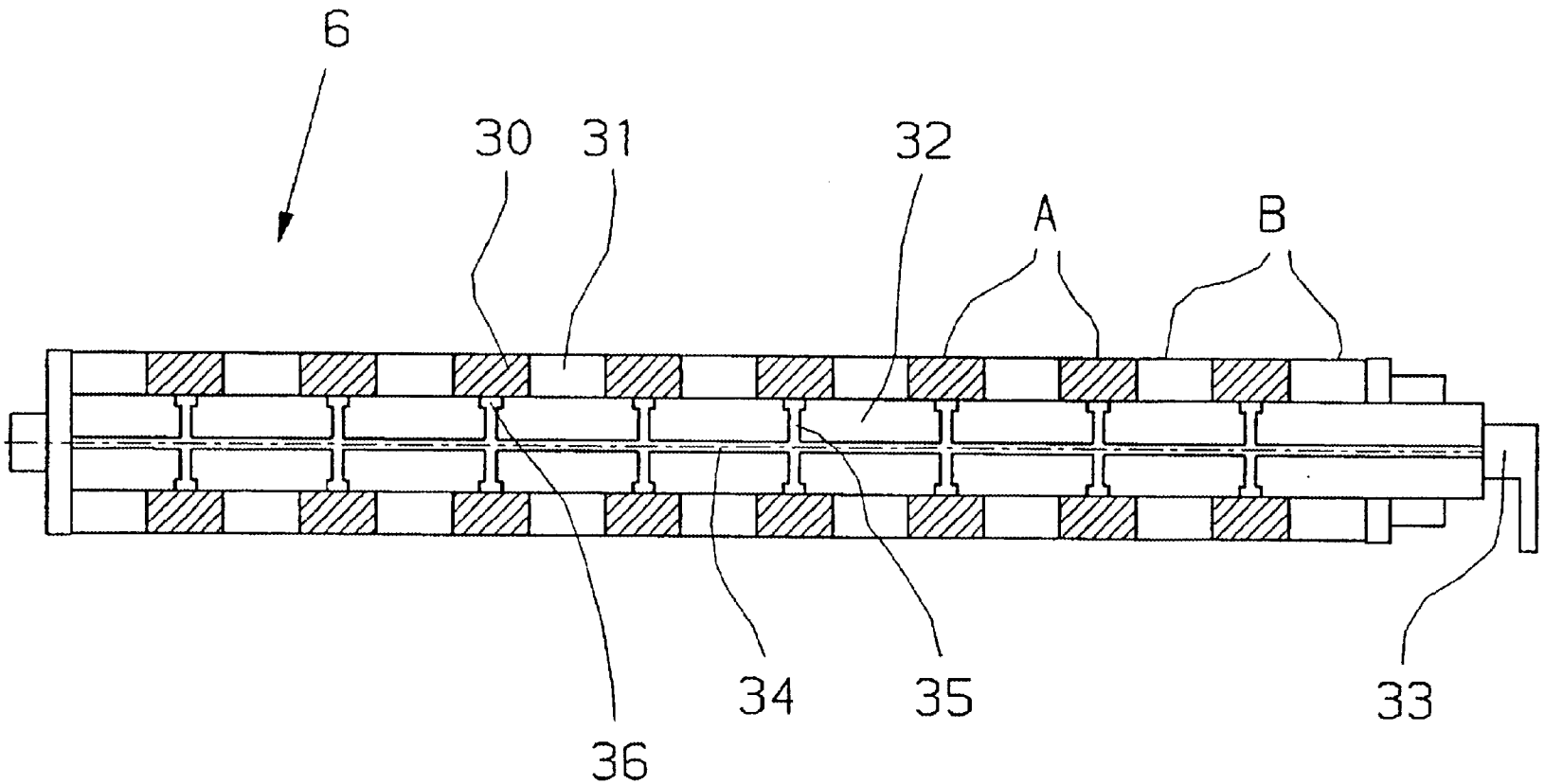
Figure 10:
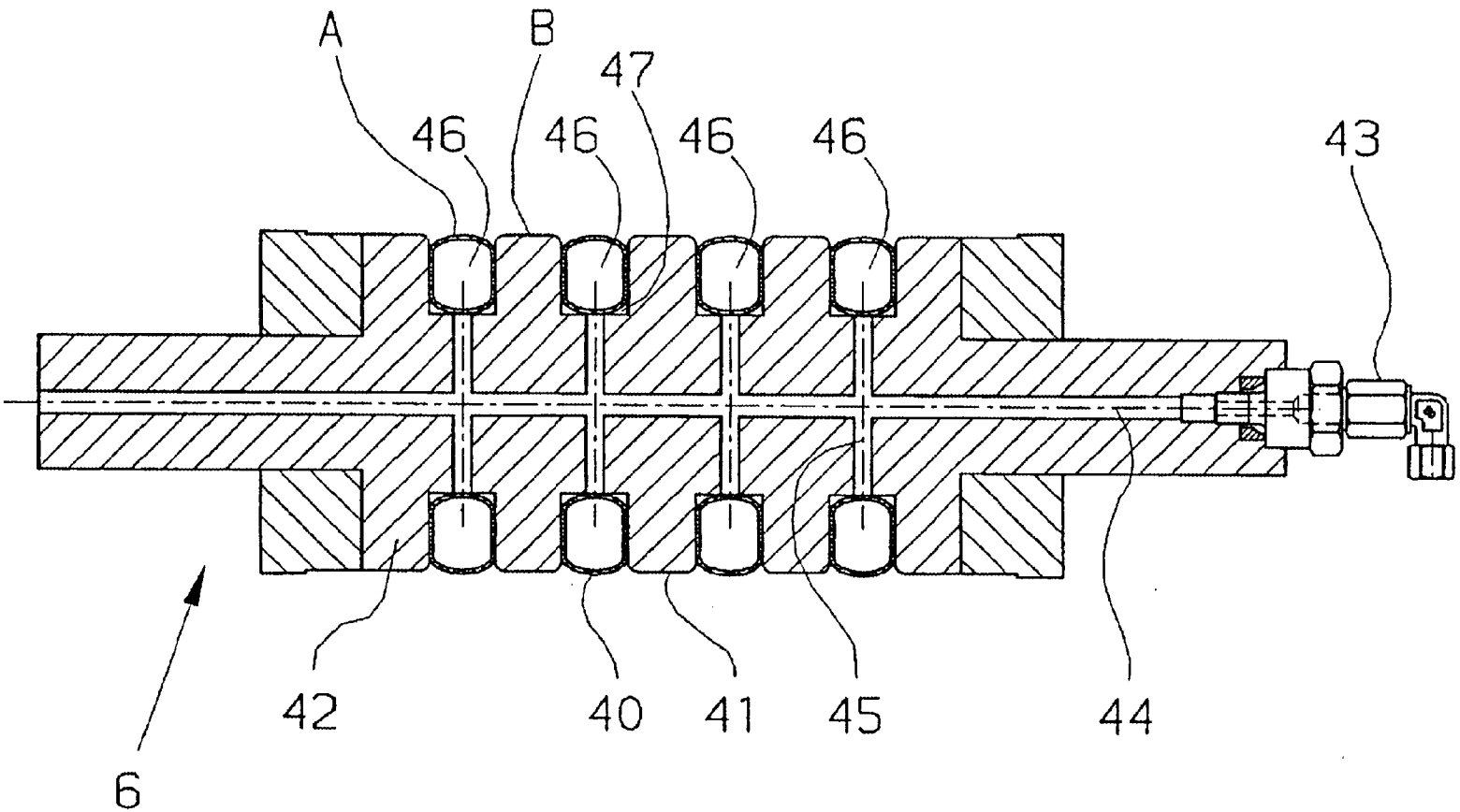
Figure 11:
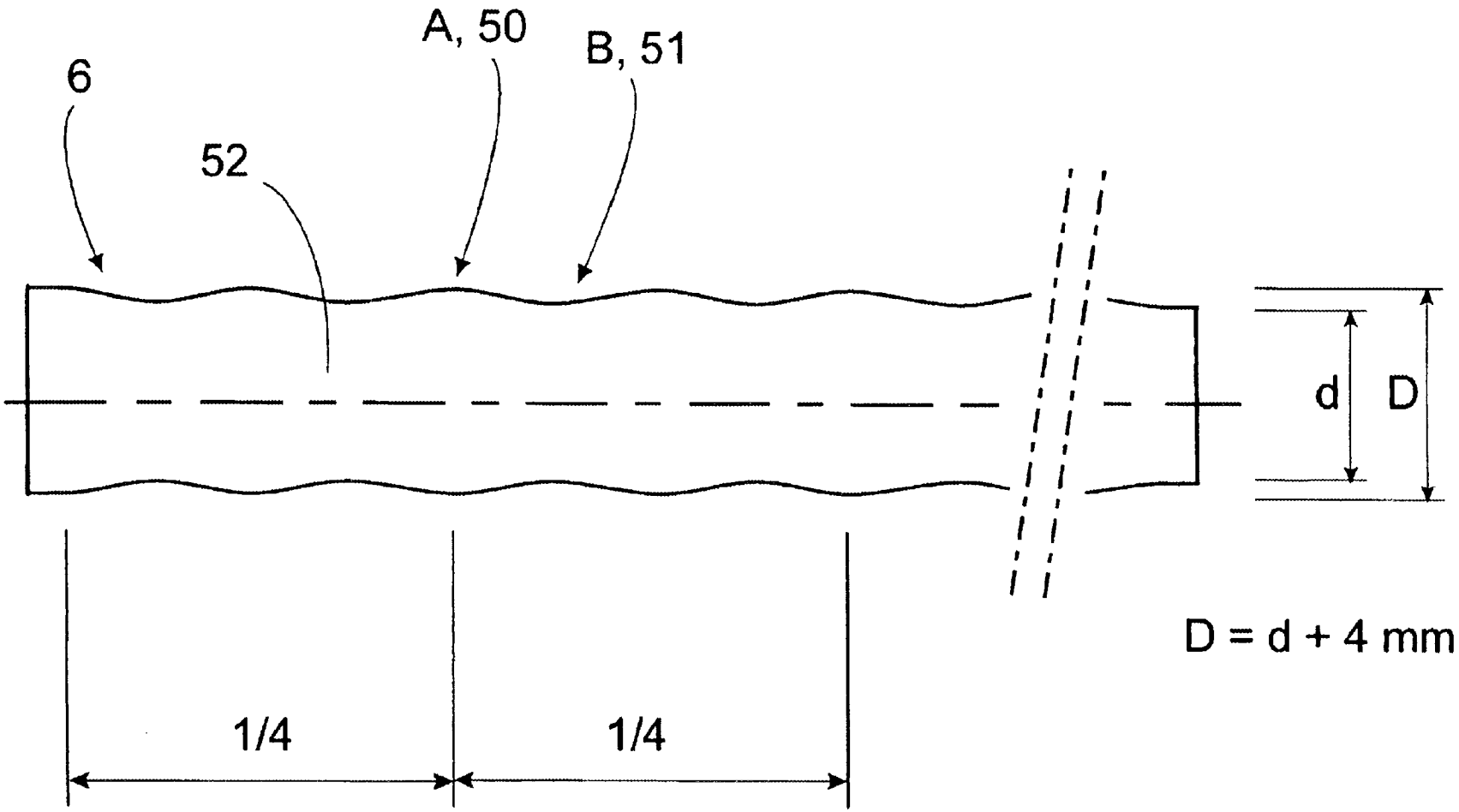
Figure 12:
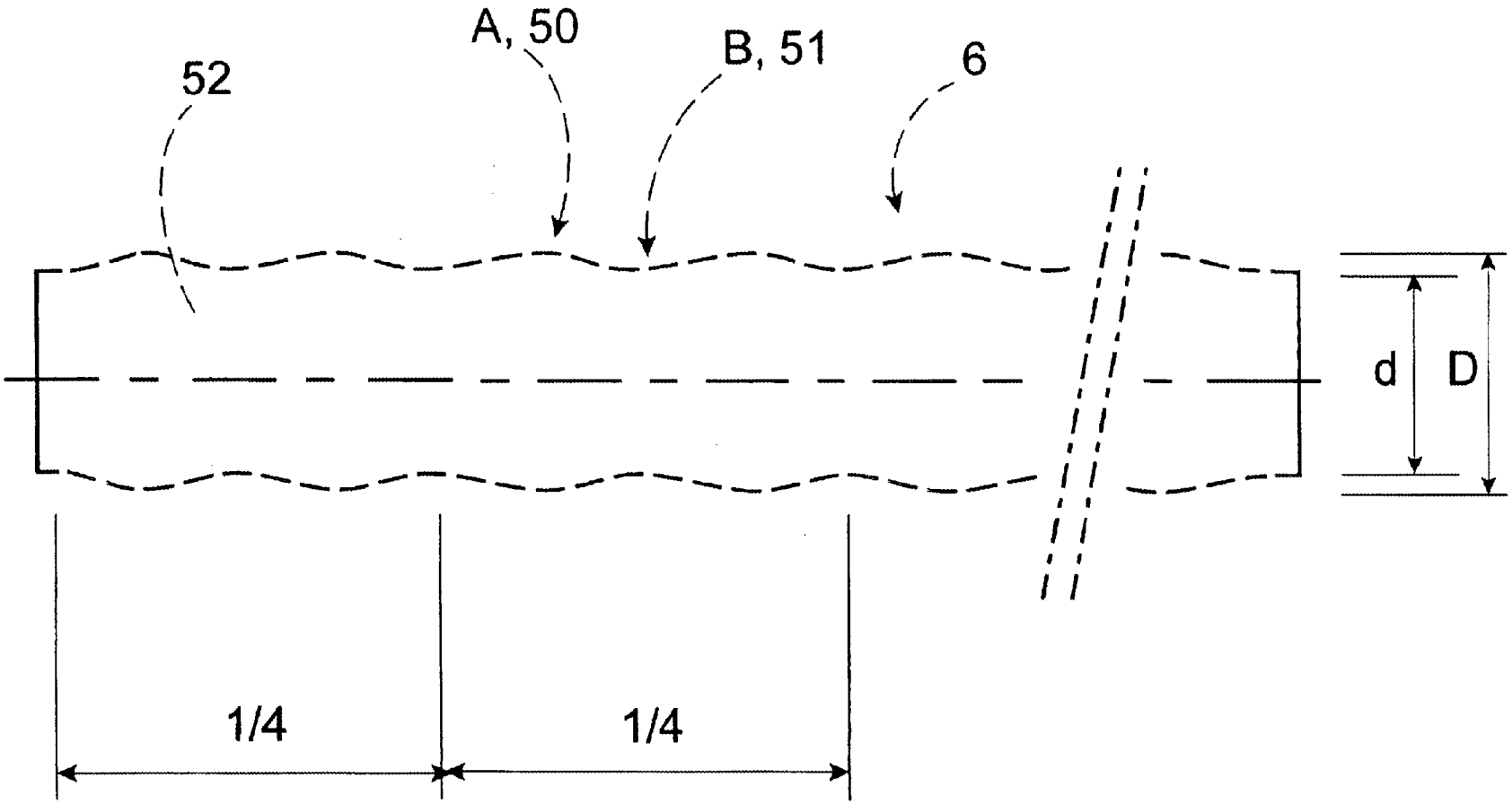

Preferred embodiments of the invention will now be detailed with reference to the drawings in which:

FIG. 1 is a cross-sectional view through a printing unit stack incorporating two rotational body configurations in accordance with the invention, FIG. 2 is a longitudinal view X of a rotational body configuration in a first embodiment, FIG. 3 is a cross-sectional view through an adjustment means of the rotational body configuration shown in FIG. 2, FIG. 4 is a longitudinal view perpendicular to the view X of the rotational body configuration shown in FIG. 2, FIG. 5 is a further cross-sectional view of the rotational body configuration shown in FIG. 2, FIG. 6 is a rotational body configuration in accordance with a second preferred embodiment, FIG. 7 is a cross-sectional view of the second embodiment in a MIN and MAX setting, FIG. 8 is a rotational body configuration in a third embodiment, FIG. 9 is a rotational body configuration in a fourth embodiment, FIG. 10 is a rotational body configuration in a fifth embodiment, FIG. 11 is a rotational body configuration in a sixth embodiment and FIG. 12 is a modified version of the rotational body configuration shown in FIG. 11.

DESCRIPTION OF THE PREFERRED EMBODIMENT

FIG. 1 illustrates a four high printing tower of four stacked printing units, in which a web is printed on both sides in four colors. The four printing units are stacked in two H bridges. Each of the four printing units comprises two printing cylinders configured as rubber blanket cylinders with downstream plate cylinders. Each of the plate cylinders transfers its print image to its printing cylinder, and the printing cylinder transfers it to the web W. The invention is not limited to the configuration of the printing units shown in H bridges or to a four high printing tower and, in principle, also not to a stacked configuration.

In the printing production shown in FIG. 1, the web passes through the printing nip 1, the printing nip 2, the printing nip 3 and the printing nip 4 in sequence, and is printed with a color, respectively, in each of the printing nips 1 to 4 on both sides by the advanced printing cylinders, and in each of the printing nips 1 to 4 with another color. Upstream of the printing unit with the first nip 1 is an input roll, and downstream of the last nip 4 of the stack roll is an output roll, both arranged in the known manner. The output roll may also be configured as the delivery roll.

The web W is printed in wet offset print, it thereby becoming moist and swollen. If no correction measures are taken, the web width, measured transversely to the running direction of the web W, will increase from nip to nip and the printed images printed in sequence in the printing nips 1 to 4 will not match in the transverse direction of the web, i.e. register errors will occur in the transverse direction.

To prevent, or at least to reduce, such register errors in transverse direction, the web width is reduced in the path of the web W from the printing nip 2 to the printing nip 3, directly following in the production shown. For this purpose, a device for correcting the web width is arranged between the printing nips 2 and 3. The device comprises a rotational body configuration 6, which in FIG. 1 is depicted simplified as a simple deflector roll. The rotational body configuration 6 may also constitute actually just one roll and, in preferred applications, may also be used, in fact, only as a deflector roll. However, the rotational body configuration 6 is especially configured for dual application, i.e. as a means for correcting web width, on the one hand, and as a deflector means, on the other.

The rotational body configuration 6 is arranged directly upstream of the printing nip 3 and, in this arrangement, also fulfills the function of linear guidance of the web W. This linear guidance function is fulfilled for the two printing units with the printing nips 3 and 4 by the rotational body configuration 6 and the delivery roll downstream of the printing nip 4. The web is tensioned between the rotational body configuration 6 and the delivery roll. Due to the linear guidance, the web, without partially winding around the printing cylinder, is guided through the two printing nips 3 and 4, formed there between. The printing cylinders, forming the printing nips 3 and 4, can be retracted from the web, upon the web W passing through, or can be advanced into the printing positions as shown. The rotational body configuration 6 thus also additionally assists the so-called flying side change upon continued production.

As, for example, is represented in FIG. 2 in a first embodiment, the web W is deformed in a wave-like manner in transverse direction by means of the rotational body configuration 6, the width of the web being thereby reduced. To achieve this, the web W is guided between the upstream printing nip 2 and the downstream printing nip 3, each relative to the rotational body configuration 6, so that it partially winds around the rotational body configuration 6 in the represented printing production, in which the web is already printed before entering the downstream printing nip 3, and thus moistened. For this purpose, a deflector means is arranged between the upstream printing nip 2 and the rotational body configuration 6, which may be a simple deflector roll or a further rotational body configuration 5 for wave-like deformation of the web W. Between the two printing nips 2 and 3, the web W is thus not linearly guided, but rather deflected to attain partial winding around of the rotational body configuration 6 in accordance with the invention. A deflector means used for this purpose may itself be configured as the rotational body configuration 5, partially wound around, in accordance with the invention. It is in principle also possible, although less preferred, to eliminate the rotational body configuration 6 and to undertake web width correction solely by means of the partially wound around rotational body configuration 5. If, in this case, no linear guide means are provided directly downstream of the printing nip 2 and directly upstream of the printing nip 3, then no flying side change is possible, however. Such linear guide means are provided preferably, however, as shown in the example embodiment so that all printing cylinders of the stack can be advanced and retracted for a flying side change, i.e. without interrupting production.

Also indicated in FIG. 1 is the alternative use of the rotational body configuration 6 as a pure deflector roll.

If the same stack is used in another printing production, for example, for two-color printing of two webs, respectively, the one web W' of these two webs may be input into the stack from the side between the two printing nips 2 and 3, and be deflected by the rotational body configuration 6, and, like already the web W of the first printing production, be fed to the downstream printing nip 3. If the web W' has not yet been printed, a web width correction is not necessary, and is also not affected by the rotational body configuration 6. In principle however, in this alternative printing production, the web W' can also be corrected in its width by imposing a wave-like profile by means of the rotational body configuration 6, if this should be desired because of prior moistening of the web W'.

Illustrated in the subsequent FIGS. are preferred embodiments of the rotational body configuration 6. The deflector means 5, arranged directly upstream of the rotational body configuration 6 in the path of the web W, may be one such rotational body configuration.

FIGS. 2 to 5 illustrate a first embodiment of a rotational body configuration 6, to which reference is made in its entirety in the subsequent description. The rotational body configuration 6 comprises in the first embodiment two arrays of rolls, namely an array of first rolls 10 and an array of second rolls 11, each of which is mounted so it can swivel around a swivel axis common to each array at a machine frame.

FIG. 2 illustrates the rotational body configuration 6 in a longitudinal view X perpendicular to the running direction of the web W. The first rolls 10 and the second rolls 11 are arranged alternatingly in sequence in the axial direction of the rotational body configuration 6, i.e. transversely to the running direction of the web. In this alternating arrangement, the first rolls 10 protrude further towards the web than the second rolls 11. The shell surface areas of the first rolls 10 form protruding shell portions A relative to the web W, and the shell surface areas of the second rolls 11 form, relative to the web W, retracting shell portions B as compared to protruding shell portions A. Since the moistened web W partially winds around the rotational body configuration 6 under tension, the web W is imposed in the transverse direction with the wave-like profile represented in FIG. 3, with which it enters the downstream nip 3. During partial winding around, the web W is supported and guided in both the protruding shell portions A and retracting shell portions B, i.e. it also contacts in the retracting shell portions. The result is a particularly clean, smooth linear guidance of the web W. The first rolls 10 are formed with cambered or crowned shell surface areas, which in the example embodiment are identical to the protruding shell portions A. The web W is thus in full contact with the rotational body configuration 6 over large surface areas. The retracting shell portions B could be curved correspondingly inwards. However, a linear cylindrical configuration of the second rolls 11 is sufficient, as shown in the example embodiment.

The protruding shell portions A and the retracting shell portions B are movable relative to each other in the radial direction of the rotational body configuration 6 to permit varying the extent of the web width reduction. FIG. 2 shows the rotational body configuration 6 in its extreme position, in which the protruding shell portions A protrude furthest in the direction of the web relative to the retracting shell portions B. The waviness and the extent of the reduction in the web width are greatest in the extreme position of the rotational body configuration 6.

FIGS. 3 and 4, in combination, best illustrate variation of the protruding shell portions A and the retracting shell portions B relative to each other. FIG. 4 is a plan view of the rotational body configuration 6, on its side facing away from the web. FIG. 3 shows, in a view perpendicular to the axial direction of the rotational body configuration 6, an adjusting means for relative adjustment of the protruding shell portions A and the retracting shell portions B. In FIG. 3, the rotational body configuration is also shown in the extreme position illustrated in FIG. 2. FIG. 4 shows the rotational body configuration 6 in a neutral position, in which the axis of rotation of all the rolls 10 and 11 are in line and form a common neutral position axis of rotation N. In the neutral position, the protruding shell portions A protrude merely by the extent of their crowning beyond the retracting shell portions B in the direction of the web W. The protruding extent in the neutral position is so slight that the width of the web W in the neutral position is not changed by the rotational body configuration 6 or, at most, to an extent which is of no relevance in practice. In the neutral position, the edges of the first rolls 10 and second rolls 11 are at the same level, relative to the web.

The movement of the rolls 10 and 11, and thus in particular of the protruding portions A and retracting portions B, from the neutral position into the extreme position or a position inbetween is achieved axially symmetric relative to the neutral position axis of rotation N. The protruding portions A are advanced, upon adjustment from the neutral position, always sufficiently radially relative to the axis of rotation of the first rolls 10 in the direction of the web as the retracting portions B are retracted from the web radially relative to the axis of rotation of the second rolls 11, i.e. the neutral position axis of rotation N remains the center line in every adjustment position of the axis of rotation of the first rolls 10 and in every adjustment position of the axis of rotation of the second rolls 1. In FIG. 2, the in-line arrangement of the axis of rotation of the first rolls 10 for the extreme position is identified by P, and the in-line arrangement of the axis of rotation of the second rolls 11 is identified by Q.

It is this axially symmetric adjustment that varies the waviness of the web W, whereas the path of the web, relative to a neutral line extending in the transverse direction of the web between the wave crests and wave troughs of the web W, remains the same. Setting the web width in accordance with the invention is thus achieved without changing the length of the web between the upstream printing nip 2 and the downstream printing nip 3, i.e. setting the web width in accordance with the invention results in no circumferential register error.

Each of the first rolls 10 and second rolls 11 is rotatively mounted on swivel arms 18 and 14, respectively, the swivel arms 14 and 18 being secured non-rotatively and non-shiftably on a swivel shaft 13 and 17, respectively. The two swivel shafts 13 and 17 run parallel spaced away between two opposite side walls 8 and 9 of the machine frame transversely to the running direction of the web, and are each rotatively mounted around their longitudinal axis at the side walls 8 and 9. The swivel arms 14 protrude from the swivel shaft 13 and the swivel arm 18 from the swivel shaft 17 perpendicularly and towards each other. Protruding at right angles from their front ends are pins, on which the rolls 10 and 11 are rotatively mounted. Mounted at the side wall 8 is an adjustment means with a drive M, with which the two swivel shafts 13 and 17 can be rotated in opposite directions at exactly the same angular velocity. All the swivel arms 14 and 17 have the same length. The two swivel shafts 13 and 17 are coupled to each other for synchronous adjustment in the aforementioned sense and with the drive M via an angular gear. The drive M and the angular gear form a synchronous adjustment means for the two arrays of rolls 10 and 11.

The drive comprises a rotary motor, including a controller and a driven shaft 19*a*, configured as a fine-threaded spindle. The driven shaft 19*a* is again rotatively mounted at its front end at the side wall 8. Running on the spindle thread is a threaded nut with a slider 19*b* secured thereto. Secured to the slider 19*b* is a lever 12, rotatable around an axis perpendicular to the direction of travel of the slider 19*b*. The lever 12 is formed by a web, which is secured non-rotatively on the swivel shaft 13 and rotatable at the slider 19*b* around an axis perpendicular to the direction of travel of the slider 19*b* and parallel to the shaft 13. Via the lever 12, linear travel of the slider 19*b* is converted into a corresponding rotation of the shaft 13. The swivel arms 14, secured in particular non-rotatively on the shaft 13, and thus the second rolls 11, are swiveled with the rotation of the shaft 13. A synchronous swiveling of the first rolls 10 in the opposite direction is effected by levers arranged mirror-symmetrical to the neutral position axis of rotation N, and coupling to the lever 12 by means of an inherently stiff strap 15. For the coupling, the lever 12 is elongated straight beyond the swivel shaft 13, as viewed from the slider 19*b*. Opposite thereto, a lever 16 protrudes from the swivel shaft 17. The free ends of the levers 12 and 16 are flexibly connected to each other by means of the strap 15 such that, when the lever 12 is swiveled around the swivel shaft 13, the lever 16 is caused to swivel around the swivel axis 17, and, at the same time, the lever 16 and the elongated portion of the lever 12, opposite thereto, always remain parallel. The levers 12 and 16 have the same length between the swivel shafts 13 and 17 and the rotational axes with the strap 15. Since the swivel levers 14 are secured on the swivel shaft 13 perpendicular to the elongated portion of the lever 12, and the swivel levers 18 are secured to the swivel shaft 17 perpendicular to the lever 16, and furthermore as the swivel axes formed by the swivel levers 14 and 18 are of equal length, an equally large swiveling of the first rolls 10 and the second rolls 11 is effected in opposite direction with respect to the neutral position axis of rotation N.

The maximum adjustment, measured as the radial spacing between the axes of rotation of the first rolls 10 and the axes of rotation of the second rolls 11 is in the range of 0.5 to 3 mm, preferably max. 2 mm. The diameter of the rolls 10 and 11 ranges between 70 and 120 mm, in the example embodiment it is 90 mm. The width of the rolls 10 and 11, measured in the axial direction of the rotational body configuration 6, ranges between 30 and 70 mm, in the example embodiment it is 50 mm. The spacing between every two adjacent rolls 10 and 11 is less than the width of the rolls, and is preferably less than 30 mm; in the example embodiment, a clear distance of 20 mm remains between every two adjacent rolls 10 and 11. This spacing is necessary to accommodate the swivel levers 14 and 18. The number and dimensions of the rolls 10 and 11 are selected so that at least one complete wave crest or wave trough is formed on a ¼ of the web width. This would be the case in the first embodiment for a 4/4 wide web. Preferably, protruding shell portions A and retracting shell portions B are formed in such a number that two or more complete wave crests or wave troughs are configured per ¼ web width. What has been said above with regard to geometric dimensioning also correspondingly applies to the other embodiments of the rotational body configuration 6.

Adjusting the protruding shell portions A and the retracting shell portions B, i.e. the rolls 10 and 11 forming them in the example embodiment, is done as a function of the web tension S, web speed V, type of paper T and web moisture F, or one or more selections of these parameters. These are the four input variables for automatic assisted control of the drive M, i.e. the controller forms therefrom the controlled variable for setting its control element, namely the motor of the drive M in the sense of maintaining the web width constant. Instead of a controller, a regulator of the drive M may be employed. In this case, the setting variable is directly formed by the difference between the wanted and actual value of the web width. The web width is sensed by suitable sensors either at the web edges, at the side mirror edge or at suitable printing marks.

FIG. 5 illustrates the rotational body configuration 6 in a side view in its neutral position. Marked is the wrap angle $\alpha$, indicating an angular measurement of the peripheral length of the partially wound round shell surface areas of the protruding shell portions A and the retracting shell portions B, which are concealed in FIG. 5. The wrap angle $\alpha$ is at least 3°, and preferably at least 10°. In the example embodiment it is 20°. The details given with regard to the wrap angle $\alpha$ also equally apply to the other embodiments of the rotational body configuration 6.

FIGS. 6 and 7 illustrate a second particularly preferred embodiment of the rotational body configuration in accordance with the invention. This comprises a roll body 61, mounted between a left machine frame and a right machine frame (not shown). Non-rotatively mounted on the roll body 61 are a number of eccentric sleeves 60*a*, 60*b*. As an alternative to the multiple arrangement of eccentric sleeves 60*a*, 60*b* shown, a single eccentric sleeve, in the form of a comparatively long cam body, may be non-rotatively mounted on the roll body 61 with a number of different eccentric sections in the axial direction of the roll body 61 to mount each of the cylinder sleeves. The roll body 61 itself may also be configured as a kind of camshaft with eccentric sections configured juxtaposed. In the rotary position of the roll body 61 shown in FIG. 6, the sections of the eccentric sleeves 60*a*, with greatest projection above the longitudinal axis of the roll body 61, are arranged beside sections of the eccentric sleeves 60*b*, having the greatest projection below the longitudinal axis of the roll body 61.

As shown in FIG. 6, a number of cylinder sleeves 62, 63 are rotatively mounted juxtaposed on the eccentric sleeves 60*a*, 60*b* in the axial direction of the roll body 61, each rotatable independently of the other. In the embodiment shown, the cylinder sleeves 62, 63 and the accompanying eccentric sleeves 60*a*, 60*b* are configured alternatingly different, so that protruding shell portions A and retracting shell portions B are formed by alternate protruding and retracting cylinder sleeves. Instead of this alternating arrangement, it is also possible, in principle, to select any other expedient alternating sequence of cylinder sleeves 62, 63 to give the peripheral surface of the rotational body configuration 6 a suitable wave form.

According to FIG. 6, the cylinder sleeves 62, 63 are cylindrical. However, alternatively, these could also have a concave or convex profile, seen in axial direction, or, alternatingly, a different profile, e.g. cylindrical and concave or convex. The cylinder sleeves 62, 63 may also comprise different surface roughness. The rotational body configuration forms, at its outer shell surface area, a straight line, extending parallel to the axis of rotation of the rotational body configuration. This line is obtained by arranging the eccentric sleeves 60*a* and 60*b* in corresponding angular positions of rotation and by making the cylinder sleeves 62 and 63 correspondingly thick. Due to using the eccentric sleeves 60*a* and 60*b* in a corresponding arrangement relative to each other, the spacing (measured in radial direction) between the protruding shell portions A and the retracting shell portions B evenly increases, as seen over the periphery of the rotational body configuration, starting with the straight line, to both sides up to the diametrically opposed side of the rotational body configuration. In FIG. 6, the rotational body configuration shown in a longitudinal section, covering the two extremes, namely the straight line, on the one hand, and the maximum spacing between protruding shell portions A and retracting shell portions B in the radial direction, on the other.

The roll body 61 is mounted rotationally adjustable in the machine frame for adjustment around the axis of rotation N. Each rotative setting can be mechanically arrested or be suitably controlled, for example, also by electronic control. An electric motor M or a drive means is provided for adjustment of the roll body 61, having a number of control inputs T, S, V, F for rotatably positioning the roll body 61 around its axis of rotation via the spur gear or gear assembly 64, illustrated schematically, for slipless transmission. In the example embodiment, the axes of rotation of the cylinder sleeves 62 and 63 run eccentric to the axis of rotation of the roll body 61, i.e. staggered alternatingly by 180°.

Torsion of the roll body 61 preferably occurs infinitely variable, it rotating the radially protruding sections of the eccentric sleeves 60*a*, 60*b* around the axis of rotation of the roll body 61 together with the roll body 61, so that the shell portions A, B move against or away from the paper web. The transition from the extreme wave-like line to the straight line staggered by 180° is smooth. Upon adjustment of the roll body 61, the theoretical mean path of the paper web is always maintained due to the permanent change in the radial spacing between the two extremes of the outer contour of the rotational body configuration, so that the length of the web likewise remains constant between an upstream print location and a downstream print location, and thus no adaptation of the circumferential register needs to be undertaken.

Rotatably positioning the roll body 61 also occurs in accordance with the paper quality, web speed and/or pressure application of the web.

The nip s, evident from FIG. 6, between two axially adjacent cylinder sleeves 62 and 63, in each case, is preferably maintained as small as possible to achieve optimum web guidance of the protruding and retracting shell portions A, B. When retrofitting the rotational body configuration, the geometrical relationships of the eccentric sleeves 60*a*, 60*b* and/or of the cylinder sleeves 62, 63 can be varied, a diameter ratio D1:D2 of approx. 0.9–0.98 is preferred. More preferred is a diameter ratio D1:D2 of approx. 0.95. A preferred length ratio L1:L2 is approx. 0.05–0.3, more preferred being approx. 0.15, whereby D1 and L1 denote the outer diameter and the length of the cylinder sleeves 62, and D2 and L2 denote the outer diameter and the length of the cylinder sleeves 63.

The second embodiment is particularly of advantage since, in particular due to its simple configuration, it can be manufactured cost-effectively and is uncomplicated to maintain, because the eccentric and cylinder sleeves are individually replaceable. When the cylinder sleeves are replaced by cylinder sleeves of other dimensions, for example only alternatingly in each case, the rotational body configuration, shown, can be very flexibly and cost-effectively retrofitted. A particular advantage is also that setting while maintaining the path of the web constant takes place merely by rotation of the roll body 61, i.e. of the rotational body configuration 6 as a whole, around the axis of rotation N. The axis of rotation N of the roll body 61 is simultaneously the neutral position axis of rotation of the rotational body configuration 6.

FIG. 7 illustrates the rotational body configuration 6 in accordance with a second embodiment in two different rotary settings of the roll body 61, namely in the neutral position N, where the surfaces of the first cylinder sleeve 62 and of the second cylinder sleeve 63 in the contact portion are practically in line with the paper web, and a maximum setting (lower illustration), where the roll body 61 is rotatably positioned at a maximum, so that the first cylinder sleeves 62 form a protruding shell portion A, and the second cylinder sleeves 63 form a retracting shell portion B. In this set position, the retracting shell portion B is maximally retracted with regard to the protruding shell portion A.

FIG. 8 shows the rotational body configuration 6 in a third embodiment, in which it is configured as a roll having axially advanceable ring elements 20.

The rotational body configuration 6 of the third embodiment comprises a roll body 22, which, like known deflector rolls or by being mounted in eccentric bearings, is rotatively mounted so as to be swivable at the machine frame. On the roll body 22, concentric to the axis of rotation thereof, in the axial direction, i.e. along the axis of rotation, elastically deformable ring elements 20 and dimensionally stable ring elements 21 are arranged alternatingly and directly and closely juxtaposed. The ring elements 20 and 21 are arranged axially shiftable on the roll body 22, and are preferably non-rotatably locked. The outermost of the ring elements 20 and 21, which is a deformable ring element 20 in the example embodiment, but, however, in principle, may also be formed by a dimensionally stable ring element 21, is urged against an axial counterbearing 24. At the opposite side of the roll body 22, a thruster element 23, mounted axially shiftable on the roll body 22, is urged against the outermost of the ring elements 20 and 21, which is likewise a deformable ring element 20, but which, in principle, may also be formed by a dimensionally stable ring element 21. The ring elements 20 and 21, juxtaposed in line, are incorporated between the thruster element 23 and the counterbearing 24, and are urged axially against each other by advancement of the thruster element 23 towards the counterbearing 24. The ring elements 20 are elastically curved outwards and rotate evenly over their full circumference under the axial thrust introduced on both sides. In the forwardly curved condition, the shell surface areas of the deformable ring elements 20 form the protruding shell portions A, and the shell surface areas of the dimensionally stable ring element 21 form the retracting shell portions B of the rotational body configuration 6. In FIG. 9, the rotational body configuration is shown in its neutral position, in which the ring elements 20 and 21 form a smooth straight, cylindrical shell surface area when the axial thrust is relieved.

The thruster element 23 is formed by an axial ball bearing. The thruster element 23 is urged by an actuator means 25 axially against the outermost of the ring elements 20 and 21. The thruster element 23 comprises an inner bearing shell, with which it is urged against the outermost of the ring elements 20 and 21, and an outer bearing shell, against which the actuator means 25 is urged. The inner bearing shell is non-rotatively, but shiftably, mounted on the roll body 22. The outer bearing shell may be likewise mounted on the roll body 22, if so, then also the actuator means 25 would also be rotatively mounted together with the roll body 22. It is preferred, however, that the outer bearing shell is rotatively and shiftably mounted on the roll body 22, so that the actuator means 25 can be secured to the machine frame. In the example embodiment, the actuator means 25 is formed by an angle bracket, rotatably secured to the machine frame on a pin 26. At a front end, the angle bracket comprises a cam, with which it is urged against the outer bearing shell of the thruster element 23 to thereby exert axial pressure on the ring elements 20 and 21.

FIG. 9 illustrates the rotational body configuration 6 in a fourth embodiment, in which it is likewise configured as a roll. In the fourth embodiment, the protruding shell portions A are likewise formed by the shell surface areas of elastically deformable ring elements 30, fully covering the periphery. The retracting shell portions B are formed by strip-shaped peripheral shell surface areas of a roll body 32 itself. The roll body 32 is mounted like known deflector rolls or by means of eccentric bearings in the machine frame.

FIG. 9 shows the rotational body configuration 6 in its neutral position, in which the rotational body configuration comprises a smooth, straight, cylindrical shell surface area. The protruding portions A are formed by pressurizing the deformable ring elements 30 with compressed air. By means of a pressure connection 33, the roll body 32 is pressurizable at one face with a compressed fluid from a pressure reservoir or from a pump. The compressed fluid, preferably compressed air, gains access through the pressure connection 33 to a central axial pressure conduit 34, extending over practically the full length of the roll body 32, and from which radial pressure conduits 35 branch. The radial pressure conduits 34 are guided down to below the deformable ring elements 30, where they port in peripheral annular passageways 36 open to the exterior for a uniform distribution of the pressurized fluid. The deformable ring elements 30 seal the annular passageways 36 from the exterior. A pressure built up in the annular passageways 36 causes outward curvature of the elastically deformable ring elements 30 radially outwards, thereby producing the protruding shell portions A of this rotational body configuration 6. Upon pressure release, the ring elements 30 return to the neutral position due to their inherent restoring forces.

FIG. 10 illustrates the rotational body configuration 6 in a fifth embodiment, which is a modification of the fourth embodiment. It substantially differs from the fourth embodiment in that the deformable ring elements of the fifth embodiment are formed by tubular, elastically dilatable ring elements 40. The deformable ring elements 40 are accommodated in recesses 47, configured circumferentially at the shell surface area of the roll body 42 and, as in the example embodiment, may be formed, for example, by simple rectangular grooves. The protruding roll body portions between the recesses 47 form at their shell surface areas 41 the retracting shell portions B of the rotational body configuration 6. The deformable ring elements 40 are pressurized by a compressed fluid, preferably compressed air, passing through a pressure connection 43, a central, axial pressure conduit 44 and radial pressure conduits 45 branching therefrom. Pressurization occurs by the compressed fluid being introduced into the ring tubes or ring elements 40, which are thereby pressurized from within and thus dilated radially outwards. It is this dilation that produces the protruding shell portions A. Upon pressure release, the ring elements 40 return to the level of the retracting shell portions B due to their inherent restoring forces, so that also this rotational body configuration 6 provides the web with a straight-cylindrical, substantially smooth shell surface area.

FIG. 11 illustrates a sixth embodiment, in which the rotational body configuration 6 is formed by a single roll body 52 which comprises a waved shell surface area. In this embodiment, the rotational body configuration 6 is configured in one piece as a steel roll or as a roll made of another suitable material. Varying the waviness is not possible. The roll body 52 comprises alternatingly axially juxtaposed thicker roll portions 50 and, compared thereto, thinner roll portions 51. The thicker roll portions 50 form the permanently protruding shell portions A, and the thinner roll portions 51 form the permanently retracting shell portions B. The shell surface area of the roll body 52 is rotationally symmetrical and runs sinusoidal in each longitudinal section with an amplitude of 2 mm. In the example embodiment, each two adjacent wave crests merge together outwardly curved. In forming the troughs, the crests are curved radially inwards only in the region of the merging, i.e. in their foot regions. The result is a sequence of long, convex crests and, compared thereto, shorter concave troughs and rounded transitions. The largest diameter D, measured as the diameter between two diametrically opposed tangents at the high points of the crests, is 4 mm larger than the smallest diameter d, measured as the distance between two parallel tangents at the low points of the troughs. This alternating sequence of protruding shell portions A and retracting shell portions B, as shown in FIG. 11, is such that two crests of the roll body 52 come to rest in the ¼ wide strip of the web.

The rotational body configuration 6 shown in FIG. 12 corresponds to that depicted in FIG. 11, the only difference being that the sequence of the protruding shell portions A and the retracting shell portions B in the longitudinal direction of the roll is 90° out of phase with that as shown in FIG. 11, as a result of which two protruding shell portions A come to rest on each of the ¼ widths of the web.

LIST OF REFERENCE NUMERALS

1 first printing nip
2 second printing nip, upstream printing nip
3 third printing nip, downstream printing nip
4 fourth printing nip
5 rotational body configuration
6 rotational body configuration

7 —
8 machine frame
9 machine frame
10 first rolls
11 second rolls
12 lever
13 shaft
14 swivel arms
15 strap
16 lever
17 shaft
18 swivel arms
19*a* spindle
19*b* slider
20 advanceable ring elements
21 dimensionally stable ring elements
22 roll body
23 thruster element
24 counterbearing
25 actuator means
26 pin
27–29 —
30 advanceable ring elements
31 dimensionally stable ring elements
32 roll body
33 pressure connection
34 pressure conduit
35 pressure conduit
36 annular passageway
37–39 —
40 advanceable ring elements
41 dimensionally stable ring elements
42 roll body
43 pressure connection
44 pressure conduit
45 pressure conduit
46 cavity
47 recess
48 —
49 —
50 protruding shell portions
51 retracting shell portions
52 roll body
60*a,b* eccentric sleeve
61 roll body 61
62 1st cylinder sleeve
63 2nd cylinder sleeve
64 gear assembly
A protruding shell portions A
B retracting shell portions B
D largest diameter
d smallest diameter
F moisture
M drive
N neutral position axis of rotation
P axis of rotation of first rolls
Q axis of rotation of second rolls
S web tension
T paper type
V web speed
W web
α wrap angle

What is claimed is:

1. A rotary printing machine arrangement, comprising:

an upstream printing nip;

a downstream printing nip;

a web passing through said upstream printing nip and said downstream printing nip and being printed in sequence;

a rotational body configuration for web width correction between said upstream printing nip and said downstream printing nip, said rotational body configuration being arranged on one side of said web rotatable in a running direction of said web, said rotational body configuration having radially protruding portions and radially recessed portions running sinusoidal in an axial direction of said rotational body configuration, said radially protruding portions alternating with said radially recessed portions in said axial direction, said radially protruding portions and said radially recessed portions deforming said web in a wave-like manner transversely to said running direction with said web winding partially around said rotational body configuration protruding portions and said web winding partially around said rotational body recessed portions by one of arranging said rotational body configuration in a path of said web between said upstream printing nip and said downstream printing nip or guiding said web to position said web path relative to said rotational body configuration between said upstream printing nip and said downstream printing nip.

2. The rotary printing machine arrangement according to claim 1, wherein said rotational body configuration is used in another printing production as a deflector roll for a web entering said downstream printing nip or leaving said upstream printing nip and not passing through the other said nip, respectively.

3. The rotary printing machine arrangement according to claim 1, wherein said rotational body configuration is movable as a whole radially to permit compensation of a change in web length between said upstream printing nip and said downstream printing nip.

4. The rotary printing machine arrangement according to claim 1, wherein a change in web length between said upstream printing nip and said downstream printing nip that may be caused by imposing a wave-like profile action for web width correction is prevented by a radial shifting of a location of said rotational body configuration.

5. A rotary printing machine arrangement, comprising:

an upstream printing nip;

a downstream printing nip;

a web passing through an upstream printing nip and a downstream printing nip and being printed in sequence;

a rotational body configuration for web width correction between said upstream printing nip and said downstream printing nip, said rotational body configuration being arranged on one side of said web rotatable in a running direction of said web, said rotational body having radially protruding portions and radially recessed portions, said radially protruding portions alternating with said radially recessed portions in an axial direction of said rotational body, said radially protruding portions and said radially recessed portions deforming said web in a wave-like manner transversely to said running direction with said web winding partially around said rotational body configuration protruding portions and said web winding partially around said rotational body recessed portions by one of arranging said rotational body configuration in a path of said web between said upstream printing nip and said downstream printing nip or guiding said web to position said web path relative to said rotational body configuration between said upstream printing nip and said downstream printing nip, wherein said rotational body configuration is used in another printing production as a deflector roll for a web entering said downstream printing nip or leaving said upstream printing nip and not passing through the other said nip, respectively.

6. A rotary printing machine arrangement, comprising:

an upstream printing nip;

a downstream printing nip;

a web passing through said upstream printing nip and said downstream printing nip and being printed in sequence;

a rotational body configuration for web width correction between said upstream printing nip and said downstream printing nip, said rotational body configuration being arranged on one side of said web rotatable in a running direction of said web, said rotational body configuration having radially protruding portions and radially recessed portions with said radially protruding portions alternating with said radially recessed portions in an axial direction of said rotational body and defining a sinusoidally varying surface with said radially protruding portions and radially recessed portions running sinusoidal in said axial direction, said radially protruding portions and said radially recessed portions deforming said web in a wave-like manner transversely to said running direction with said web winding partially around said rotational body configuration protruding portions and said web winding partially around said rotational body recessed portions by one of arranging said rotational body configuration in a path of said web between said upstream printing nip and said downstream printing nip or guiding said web to position said web path relative to said rotational body configuration between said upstream printing nip and said downstream printing nip, whereby said rotational body configuration imposes the wave-like deformation without a second intermeshing rotational body and deflects the web between said upstream printing nip and said downstream printing nip with said wave-like deformation being imposed only by the partial winding around said rotational body configuration.

7. The rotary printing machine arrangement according to claim 6, wherein said rotational body configuration is used in another printing production as a deflector roll for a web entering said downstream printing nip or leaving said upstream printing nip and not passing through the other said nip, respectively.

8. The rotary printing machine arrangement according to claim 6, wherein said rotational body configuration is movable as a whole radially to permit compensation of a change in web length between said upstream printing nip and said downstream printing nip.

9. The rotary printing machine arrangement according to claim 6, wherein a change in web length between said upstream printing nip and said downstream printing nip imposed by a wave-like profile action for web width correction is prevented by a radial shifting of a location of said rotational body configuration.

* * * * *